US010351312B2

(12) United States Patent
Iwasaki

(10) Patent No.: US 10,351,312 B2
(45) Date of Patent: Jul. 16, 2019

(54) STORAGE CONTAINER

(71) Applicant: IWASAKI INDUSTRY INC., Yamato-koriyama-shi, Nara (JP)

(72) Inventor: Yoshihisa Iwasaki, Yamato-koriyama (JP)

(73) Assignee: IWASAKI INDUSTRY INC., Yamato-Koriyama-Shi (JP)

( * ) Notice: Subject to any disclaimer, the term of this patent is extended or adjusted under 35 U.S.C. 154(b) by 0 days.

(21) Appl. No.: 15/329,412

(22) PCT Filed: Jul. 29, 2015

(86) PCT No.: PCT/JP2015/071435
§ 371 (c)(1),
(2) Date: Jan. 26, 2017

(87) PCT Pub. No.: WO2016/017662
PCT Pub. Date: Feb. 4, 2016

(65) Prior Publication Data

US 2017/0210515 A1 Jul. 27, 2017

(30) Foreign Application Priority Data

Jul. 30, 2014 (JP) ..... 2014-155315

(51) Int. Cl.
*B65D 43/16* (2006.01)

(52) U.S. Cl.
CPC ..... *B65D 43/163* (2013.01); *B65D 43/164* (2013.01)

(58) Field of Classification Search
CPC .... B65D 43/163; B65D 43/164; B65D 43/16; B65D 43/161
(Continued)

(56) References Cited

U.S. PATENT DOCUMENTS 1,565,848 A * 12/1925 De Stefani ..... B65D 43/163 215/235
2,520,508 A 8/1950 Morrison et al.
(Continued)

FOREIGN PATENT DOCUMENTS

CN 103057821 A 4/2013
DE 3211840 A1 10/1983
(Continued)

OTHER PUBLICATIONS

International Search Report, issued in PCT/JP2015/071435 (PCT/ISA/210), dated Oct. 20, 2015.
(Continued)

*Primary Examiner* — Andrew T Kirsch
*Assistant Examiner* — Don M Anderson
(74) *Attorney, Agent, or Firm* — Birch, Stewart, Kolasch & Birch LLP

(57) ABSTRACT

Provided is a storage container having a door lid whose opening and closing direction is changeable, and in which a take-out port can be accessed from various directions. The storage container includes a container body and the door lid. The container body has an outer peripheral frame defining the take-out port. The door lid can be attached to the outer peripheral frame, and opens and closes the take-out port. The outer peripheral frame includes plural coupling counterpart portions extending in directions in which the outer peripheral frame extends. The door lid includes a coupling portion detachably coupled to any of the coupling counterpart portions. The coupling portion and the coupling counterpart portions are configured such that, when the coupling portion is coupled to any of the coupling counterpart portions, the door lid can be rotated with respect to the outer peripheral frame to open and close the take-out port.

17 Claims, 9 Drawing Sheets

(58) Field of Classification Search
USPC ..... 220/245, 245.3, 259.1, 817, 818, 819
See application file for complete search history.

(56) References Cited

U.S. PATENT DOCUMENTS

| | | | |
|---|---|---|---|
| 5,577,628 | A | 11/1996 | O'Neil et al. |
| 6,176,746 | B1 | 1/2001 | Morello et al. |
| 2006/0096984 | A1 | 5/2006 | Bandoh et al. |

FOREIGN PATENT DOCUMENTS

| | | | |
|---|---|---|---|
| DE | 20318469 | U1 | 4/2004 |
| JP | 53-20241 | Y2 | 5/1978 |
| JP | 9-308567 | A | 12/1997 |
| JP | 10-250778 | A | 9/1998 |
| JP | 11-115974 | A | 4/1999 |
| JP | 11-290228 | A | 10/1999 |
| JP | 11-298164 | A | 10/1999 |
| JP | 2002-120903 | A | 4/2002 |
| JP | 2008-277713 | A | 11/2008 |
| KR | 10-1367326 | B1 | 2/2014 |

OTHER PUBLICATIONS

Komebitsu (Rice Stocker) 5kg Okome no Hokan Sink Shita -> Reizoko Hokan e, [Online], Apr. 30, 2015, [retrieval date Oct. 8, 2015], Internet: <URL: http://ameblo.jp/bowieronson/entry-12020868448.html>.

Written Opinion of the International Searching Authority, issued in PCT/JP2015/071435 (PCT/ISA/237), dated Oct. 20, 2015.

Extended European Search Report for European Application No. 15827731.9, dated Feb. 19, 2018.

Chinese Office Action and Search Report, dated Dec. 8, 2017, for corresponding Chinese Application No. 201580032144.8, with an English translation.

Chinese Office Action and Search Report for Chinese Application No. 201580032144.8, dated Aug. 3, 2018, with English translation.

Chinese Office Action, dated Apr. 1, 2019, for Chinese Application No. 201580032144.8, along with an English translation.

* cited by examiner

STORAGE CONTAINER

TECHNICAL FIELD

The present invention relates to a storage container for storing food and the like.

BACKGROUND ART

Conventionally, storage containers provided with a door type lid of an opening and closing type are well known as storage containers for storing food and the like. There are various mechanisms for opening and closing the door type lid, and examples thereof include a rotation-type mechanism and a slide-type mechanism (see Patent Literature 1). In the case of a rotation-type door type lid, the door type lid is rotated with respect to an outer peripheral frame that defines a take-out port through which articles stored in the storage container are taken out, in order to open and close the take-out port. Storage containers of this type are easily opened and closed, and can be used, for example, as a rice stocker, a pet food stocker, or the like.

CITATION LIST

Patent Literature

Patent Literature 1: JP H11-290228A

SUMMARY OF INVENTION

Technical Problem

Meanwhile, the rotation-type door type lid described in Patent Literature 1 has a fixed rotation shaft, and is opened and closed only in one direction. In the case of such a door type lid that is opened and closed in a fixed direction, the door type lid in the open state may get in the way when a user tries to access the inside of the storage container via the take-out port. For example, when a rotation axis line of the door type lid is present on the right side of the take-out port, and the user tries to access the take-out port from the right side of the storage container, the door type lid stands in front of the take-out port, and becomes a barrier wall. In order to avoid this problem, it is sufficient to arrange the storage container so that the rotation shaft is located on the side opposite to the side from which the take-out port is normally accessed, but the storage container cannot always be arranged like this, depending on an installation space.

It is an object of the present invention to provide a storage container that has a door type lid whose opening and closing direction is changeable, and in which a take-out port can be accessed from various directions.

Solution to Problem

According to a first aspect of the present invention, a storage container includes a container body and a door type lid. The container body has an outer peripheral frame that defines a take-out port. The door type lid is capable of being attached to the outer peripheral frame, and is configured to open and close the take-out port. The outer peripheral frame includes a plurality of coupling counterpart portions that extend in directions in which the outer peripheral frame extends. The door type lid includes a coupling portion that is capable of being detachably coupled to any of the coupling counterpart portions. The coupling portion and the coupling counterpart portions are configured such that, in a state in which the coupling portion is coupled to any of the coupling counterpart portions, the door type lid can be rotated with respect to the outer peripheral frame in order to open and close the take-out port.

Here, the outer peripheral frame of the take-out port of the storage container is provided with the plurality of coupling counterpart portions that extend in directions in which the outer peripheral frame extends, whereas the door type lid is provided with the coupling portion that is capable of being detachably coupled to any of the coupling counterpart portions of the outer peripheral frame. In the state in which the coupling portion is coupled to any of the coupling counterpart portions, the door type lid is rotated with respect to the outer peripheral frame in order to open and close the take-out port. Accordingly, by attaching the coupling portion of the door type lid to various coupling counterpart portions, it is possible to open and close the door type lid in various directions. That is, a storage container is provided that has a door type lid whose opening and closing direction is selectable, and in which a take-out port can be accessed from various directions.

A storage container according to a second aspect of the present invention relates to the storage container according to the first aspect, wherein the outer peripheral frame has at least three coupling counterpart portions that extend in directions in which the outer peripheral frame extends. Accordingly, it is possible to select a direction in which the door type lid is opened and closed from among at least three directions.

A storage container according to a third aspect of the present invention relates to the storage container according to the first or second aspect, wherein the door type lid has an approximately rotationally symmetric shape when viewed in a plan view. In other words, the door type lid may be configured, for example, in a shape of a substantially square, a substantially rectangle, or a substantially circle when viewed in a plan view.

A storage container according to a fourth aspect of the present invention relates to the storage container according to the third aspect, wherein the door type lid has an approximately regular polygonal shape when viewed in a plan view.

A storage container according to a fifth aspect of the present invention relates to the storage container according to the fourth aspect, wherein the door type lid has an approximately square shape when viewed in a plan view.

A storage container according to a sixth aspect of the present invention relates to the storage container according to any one of the first to fifth aspects, wherein an angle that is made by a rotation axis line of the door type lid with respect to the outer peripheral frame when the coupling portion is coupled to one of the plurality of coupling counterpart portions, and a rotation axis line of the door type lid with respect to the outer peripheral frame when the coupling portion is coupled to another one of the plurality of coupling counterpart portions is approximately 90°.

Here, by switching the attachment of the coupling portion of the door type lid between the plurality of coupling counterpart portions of the outer peripheral frame, it is possible to open and close the door type lid in directions that are different from each other by approximately 90°. That is, a storage container in which a take-out port can be accessed from directions that are different from each other by approximately 90° is provided.

A storage container according to a seventh aspect of the present invention relates to the storage container according to any one of the first to sixth aspects, wherein a rotation axis line of the door type lid with respect to the outer peripheral frame when the coupling portion is coupled to one of the plurality of coupling counterpart portions, and a rotation axis line of the door type lid with respect to the outer peripheral frame when the coupling portion is coupled to another one of the plurality of coupling counterpart portions are approximately parallel to each other.

Here, by switching the attachment of the coupling portion of the door type lid between the plurality of coupling counterpart portions of the outer peripheral frame, it is possible to open and close the door type lid in directions that are different from each other by approximately 180°. That is, a storage container in which a take-out port can be accessed from directions that are different from each other by approximately 180° is provided.

A storage container according to an eighth aspect of the present invention relates to the storage container according to any one of the first to seventh aspects, wherein the coupling portion is either one of a portion that defines an opening and an insertion portion that is inserted into the opening, and the coupling counterpart portion is the other one.

Here, the coupling portion and the coupling counterpart portion are realized as aspects of a portion that defines an opening and an insertion portion that is inserted into the opening. Accordingly, it is possible to realize the coupling portion and the coupling counterpart portion that are detachably coupled to each other with a simple configuration.

A storage container according to a ninth aspect of the present invention relates to the storage container according to any one of the first to eighth aspects, wherein the container body has a top face portion on which the outer peripheral frame is provided. The outer peripheral frame is provided at an eccentric position on the top face portion.

Here, the take-out port is formed at an eccentric position in the top face portion of the storage container. In this case, the position of the take-out port with respect to an installation space depends on the orientation in which the top face portion is arranged. Accordingly, when the orientation of the top face portion is defined so that the take-out port is located at a desired position, the case may be that the door type lid opens and closes in an undesired direction if it is not possible to select the direction in which the door type lid is opened and closed with respect to the top face portion. However, here, it is possible to select the direction in which the door type lid is opened and closed with respect to the top face portion, thus making it easy to set both the position of the take-out port and the direction in which the door type lid is opened and closed, as desired.

Advantageous Effects of Invention

According to the present invention, by attaching the coupling portion of the door type lid to the various coupling counterpart portions, it is possible to open and close the door type lid in various directions. In other words, a storage container is provided that has a door type lid whose opening and closing direction is selectable, and in which a take-out port can be accessed from various directions.

DESCRIPTION OF EMBODIMENTS

Hereinafter, a storage container according to an embodiment of the present invention will be descried with reference to the drawings.

1. Overall Configuration of Storage Container

Figure 1:
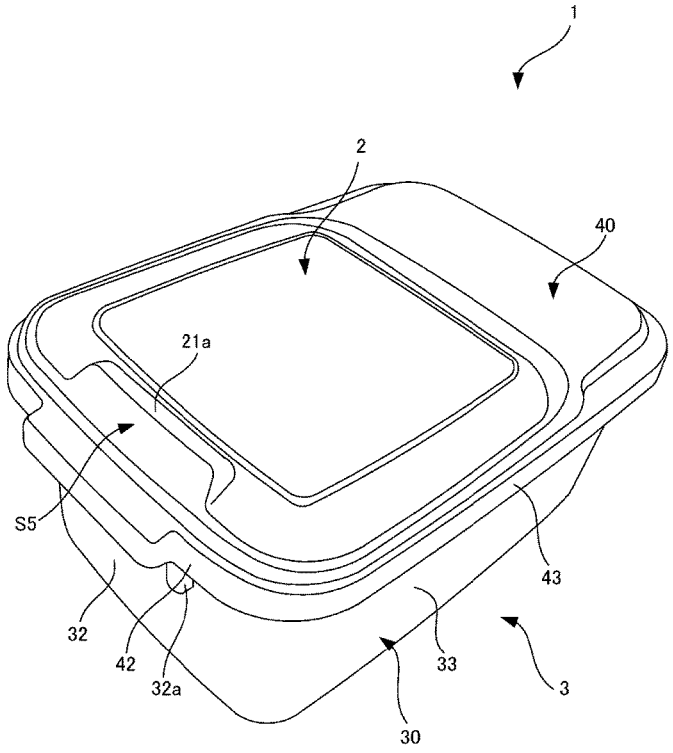
FIG. 1 is a perspective view illustrating an outer appearance of a storage container according to an embodiment of the present invention.
Figure 2:
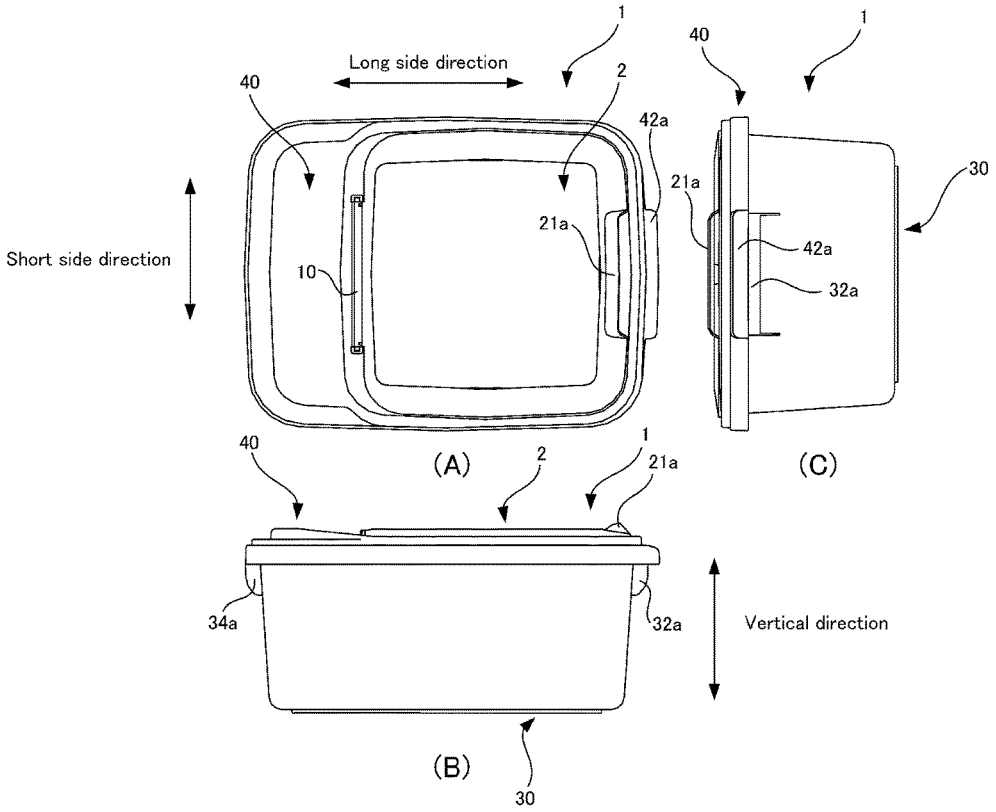
FIG. 2 shows a plan view (A) of the storage container, a side view (B) of a long side of the storage container, and a side view (C) of a short side of the storage container.

FIG. 1 is a perspective view illustrating an outer appearance of a storage container 1 according to the present embodiment, and FIG. 2 shows plan and side views of the storage container 1. Note that in the following description, "vertical direction", "short side direction", and "long side direction" are defined as in FIG. 2, and other drawings will be described using these directions as standards. Furthermore, "upper side" may sometimes refer to "top face side", and "lower side" may sometimes refer to "bottom face side".

Figure 3:
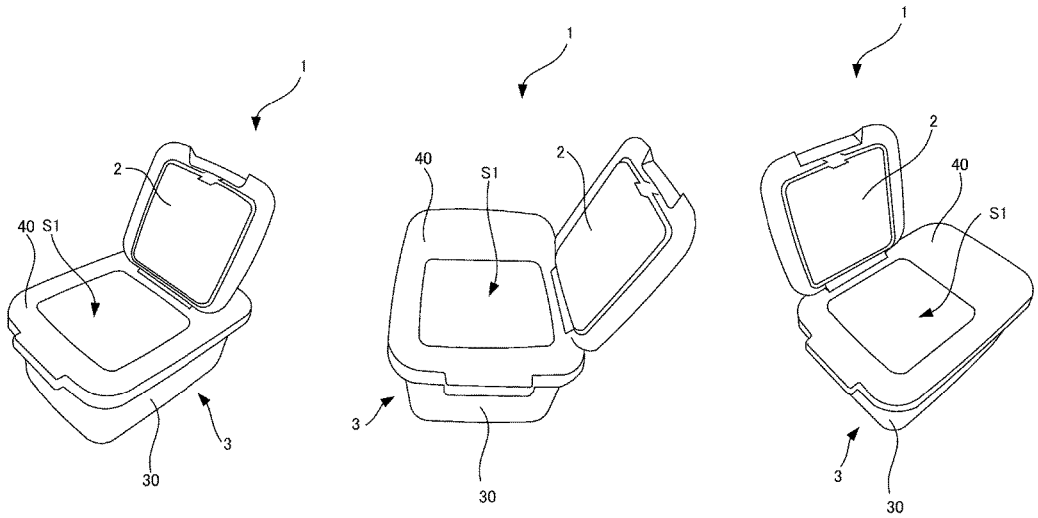
FIG. 3 illustrates aspects in which a door type lid opens in various directions.

As shown in FIG. 1, the storage container 1 is provided with a container body 3 that has, in the upper portion thereof, a take-out port S1 (see FIG. 3), and with a door type lid 2 for opening and closing the take-out port S1. The storage container 1 can be used for multiple purposes, but is most suited to store food due to its superior airtightness as will be described later, and can be used as, for example, a rice stocker, a pet food stocker, or the like. Furthermore, as shown in FIG. 3, the storage container 1 has superior characteristics in that the position at which the door type lid 2 is attached to the container body 3 can be changed, and thus it is possible to adjust the direction in which the door type lid 2 is opened and closed, on the basis of the place at which the storage container 1 is installed. The following will describe configurations of the constituent components in detail.

2. Configurations of Constituent Components 2-1. Container Body

Figure 4:
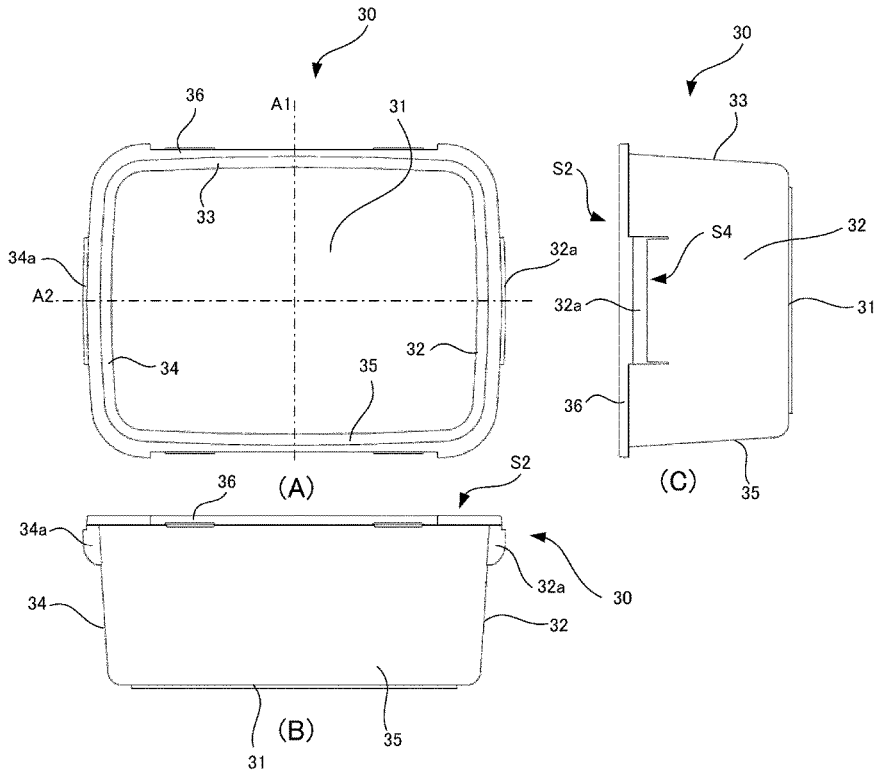
FIG. 4 shows a plan view (A) of a box, a side view (B) of a long side of the box, and a side view (C) of a short side of the box.

The container body 3 includes a box 30 that has an opening S2 (see FIG. 4) on the top face side, and a top face portion 40 that is detachably attached to the box 30 so as to close the opening S2. FIG. 4 shows plan and side views of the box 30 alone. As shown in the figures, the box 30 is a rectangular parallelepiped shaped container, and is constituted by a rectangular bottom portion 31, and side wall portions 32 to 35 that are respectively provided along the four sides of the bottom portion 31 while being raised from the four sides. Of the side wall portions 32 to 35, the side wall portions 32 and 34 extend in the short side direction, and the side wall portions 33 and 35 extend in the long side direction.

Figure 5:
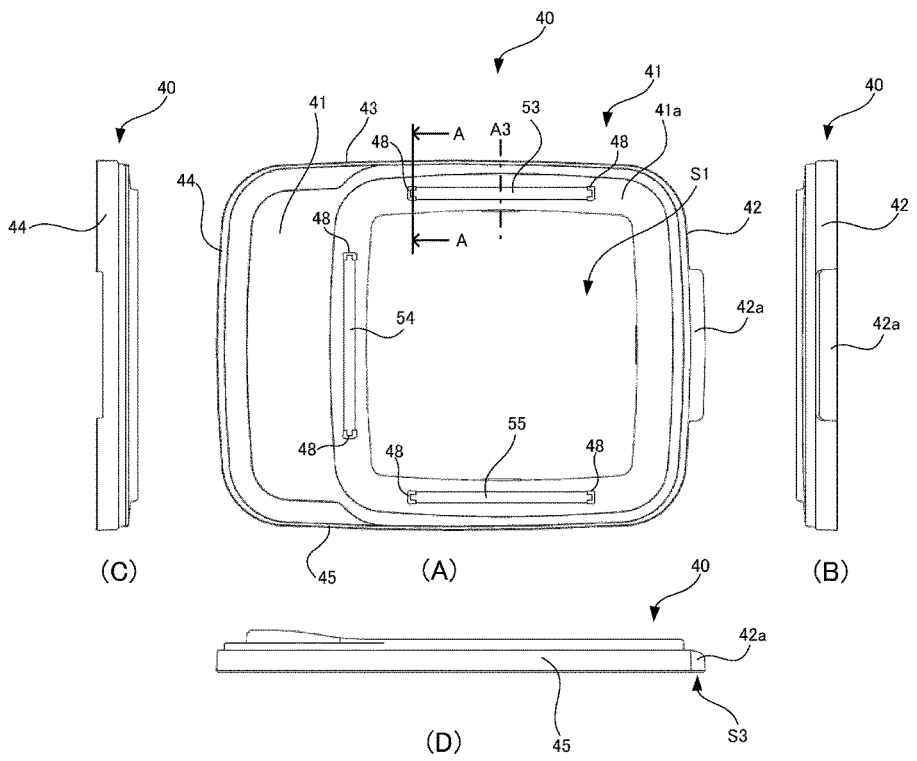
FIG. 5 shows a plan view (A) of a top face portion, a side view (B) of the short side of the top face portion that is close to the take-out port, a side view (C) of the short side of the top face portion that is far away from the take-out port, and a side view (D) of a long side of the top face portion.

FIG. 5 shows plan and side views of the top face portion 40 alone. As shown in the figures, the top face portion 40 includes a rectangular top face plate 41, and side wall portions 42 to 45 that are respectively provided along the four sides of the top face plate 41 while extending slightly downward from the four sides. The take-out port S1 is formed in the top face plate 41. The take-out port S1 is an opening that enables, when the top face portion 40 is attached to the box 30 to close the opening S2 of the box 30, access to the internal space of the container body 3, in place of the opening S2. The take-out port S1 is defined by an outer peripheral frame 41*a*, and is square-shaped in the present embodiment. Note that the outer peripheral frame 41*a* is a part of the top face plate 41, but is not necessarily a portion that is clearly distinguished from the remaining portion of the top face plate 41. The outer peripheral frame 41*a* and the remaining portion of the top face plate 41 may be configured as one piece, or may be separate components.

In the present embodiment, the take-out port S1 is formed at an eccentric position that is displaced from the center of the top face plate 41, more specifically, at a position that is decentered to one side in the long side direction. Note that, of the side wall portions 42 to 45 of the top face plate 41, the side wall portions 42 and 44 extend in the short side direction, and specifically, the side wall portion 42 is closer to the take-out port S1 and the side wall portion 44 is further away therefrom (see FIGS. 1 and 5). Moreover, of the remaining side wall portions 43 and 45 that extend in the long side direction, the side wall portion 43 is located on the front side and the side wall portion 45 is located on the rear side, when the side wall portion 42 is arranged so as to be on the left side (see FIGS. 1 and 5).

The outer peripheral frame 41*a* has grooves 53 to 55 in directions in which the outer peripheral frame 41*a* extends. The grooves 53 and 55 are formed in portions extending in the long side direction of the outer peripheral frame 41*a*, particularly, the groove 53 is arranged in the portion closer to the side wall portion 43, and the groove 55 is arranged in the portion closer to the side wall portion 45. Furthermore, the groove 54 is arranged in a portion that extends in the short side direction of the outer peripheral frame 41*a*, and that is further away from the side wall portion 42. These grooves 53 to 55, or the portions that define these grooves 53 to 55 have the same shape. Accordingly, a rotation shaft 10, which is formed on the door type lid 2 and will be described later, can be coupled selectively to any one of these grooves 53 to 55, and thus it is possible to freely select a direction in which the door type lid 2 is opened and closed from among three directions. The coupling structure and the coupling method will be described later.

As shown in FIG. 5, in the present embodiment, outer peripheral surfaces of the side wall portions 42 to 45 are flat over the entire peripheral direction except for the vicinity of the center of the side wall portion 42. The outer peripheral surface of a portion (hereinafter, referred to as "protruding portion 42*a*") in the vicinity of the center of the side wall portion 42 protrudes slightly outward from the outer peripheral surface of the remaining portion. A space S3 that is formed inside this protruding portion 42*a* has approximately such a thickness that a human finger is insertable. By inserting a finger into the space S3 and applying a force upward, it is possible to easily remove the top face portion 40 from the box 30.

Figure 6:
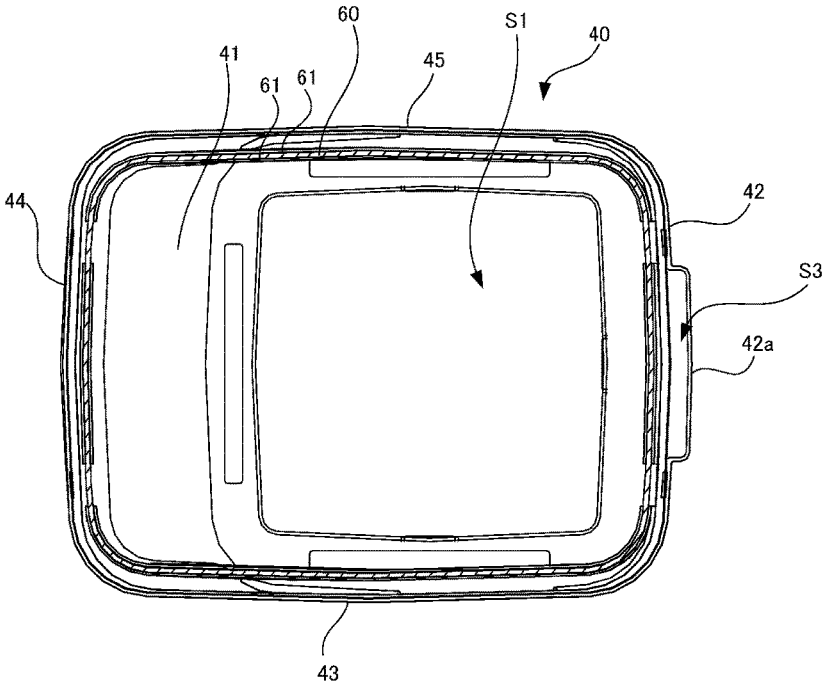
FIG. 6 is a bottom view of the top face portion.

FIG. 6 is a bottom view of the top face portion 40. As shown in the figure, the lower surface of the top face plate 41 according to the present embodiment is provided with a gasket 60 that is attached extending in the outer peripheral direction of the top face plate 41. More specifically, the lower surface of the top face plate 41 has two guide rails 61 that extend parallel to each other in the outer peripheral direction of the top face portion 40, and the gasket 60 is arranged between these two guide rails 61. The gasket 60 may be of a detachable type, or may be formed integrally with the guide rails 61 and the top face plate 41 without forming a gap therebetween. When the top face portion 40 is attached to the box 30, the gasket 60 comes in contact with and adheres intimately to flange portion 36 (see FIG. 4) at the upper ends of the side wall portions 32 to 35 of the box 30 in the entire outer peripheral direction. Accordingly, due to this gasket 60, no gap is created in the coupling part between the box 30 and the top face portion 40, and airtightness is maintained.

Note that the portion of the storage container 1 other than the gasket (including not only the gasket 60 but also a gasket 28, which will be described later) can be molded using, for example, a hard resin material such as polypropylene or saturated polyester, and the gasket can be molded using an elastic material such as rubber or elastomer (silicone, in the present embodiment).

FIGS. 2 and 4 are again referenced. In the vicinity of the center near the upper ends of the side wall portions 32 and 34 of the box 30, grip portions 32*a* and 34*a* that protrude outward from the side wall portions 32 and 34 are respectively arranged. The grip portions 32*a* and 34*a* each has a space S4 that is open downward. The space S4 has such a thickness that a human finger is insertable, and by hooking fingers in the space, a user can easily carry the box 30 or the entire storage container 1.

The box 30 according to the present embodiment is symmetric with respect to a virtual plane A1 (see FIG. 4) that penetrates the center, in the long side direction, of the box 30, and a virtual plane A2 that penetrates the center in the short side direction thereof. As a result, the top face portion 40 and the box 30 can be attached so that the side wall portion 32 corresponds to either of the side wall portions 42 and 44.

2-2. Door Type Lid

Figure 7:
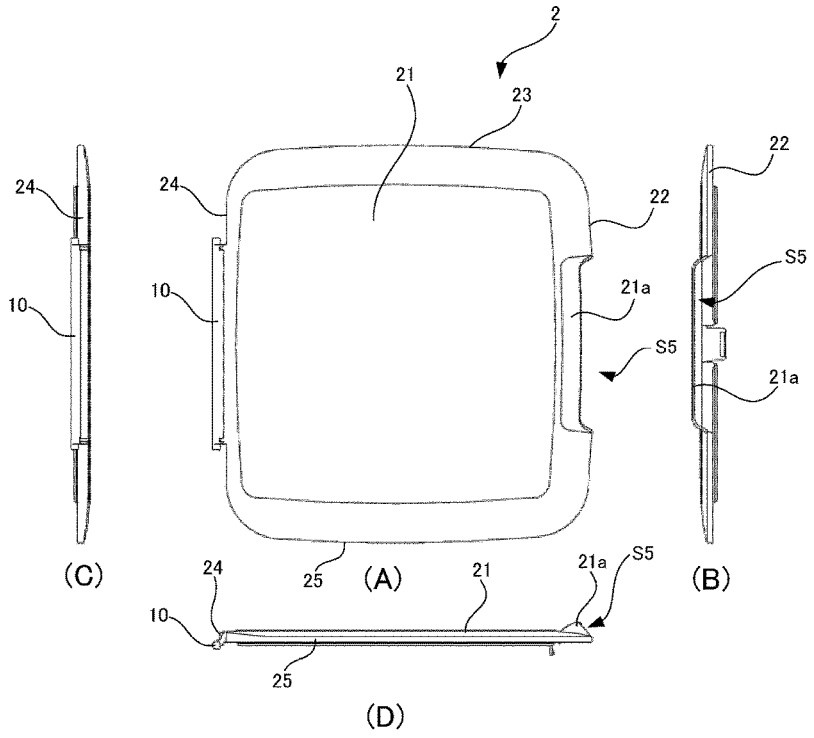
FIG. 7 shows a plan view (A) of the door type lid, a side view (B) of the side of the door type lid that is close to a handle, a side view (C) of the side of the door type lid that is close to the rotation shaft, and a side view (D) of another side of the door type lid.

The following will describe the door type lid 2 for opening and closing the take-out port S1 of the top face portion 40. FIG. 7 shows plan and side views of the door type lid 2 alone. The door type lid 2 includes a square plate-shaped door body 21, and side wall portions 22 to 25 that are respectively provided along the four sides of the door body 21 while extending slightly downward from the four sides. The door body 21 is a plate-shaped member that is slightly larger than the take-out port S1.

A portion (hereinafter, referred to as "recessed portion 21*a*") in the vicinity of the center of the area extending along one predetermined side of the outer peripheral portion of the door body 21 is recessed slightly inward relative to the remaining portion. Note that, of the side wall portions 22 to 25 of the door type lid 2, the side wall portion 22 extends along the side that corresponds to the recessed portion 21*a*, and the side wall portion 24 extends along the opposite side. Furthermore, of the side wall portions 23 and 25 extending along the remaining two sides, the side wall portion 23 is located on the rear side and the side wall portion 25 is located on the front side, when the side wall portion 22 is arranged so as to be on the right side. Furthermore, the side wall portion 22 has been cut out at a position that corresponds to the recessed portion 21*a* in the outer peripheral direction.

As shown in FIG. 7(D), the recessed portion 21*a* is inclined upward toward the outside from the inside, compared to other portions of the door body 21. As a result, a space S5 of the extent that a human finger is insertable is formed below the recessed portion 21*a*. By inserting a finger into the space S5 and applying a force upward, it is possible to easily rotate the door body 21 about the rotation shaft 10, which will be described later, and thereby to open the take-out port S1. In this sense, the recessed portion 21*a* can be referred to as "handle 21*a*".

The rotation shaft 10 about which the door type lid 2 is rotated is formed along the side wall portion 24. The rotation shaft 10 has the shape of an elongated cylindrical bar. The side wall portion 24 is inclined slightly downward to the outside in the portion corresponding to the rotation shaft 10. Furthermore, in the portions of the top face portion 40 that define the above-described grooves 53 to 55, bearing portions 48 are formed on both ends of each of the grooves 53 to 55. The bearing portions 48 are members for rotatably receiving the rotation shaft 10.

Figure 8:
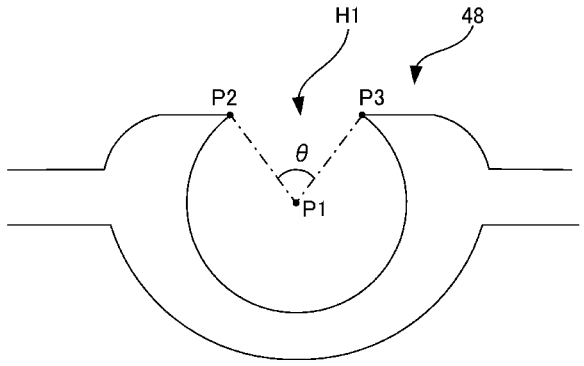
FIG. 8 is a cross-sectional view taken along a line A-A of FIG. 5.

In the present embodiment, the bearing portions 48 on both sides of each of the grooves 53 to 55 are symmetric with respect to a virtual plane A3 (see FIG. 5) that penetrates the center, in the extending direction, of the corresponding groove. FIG. 8 is a cross-sectional view taken along a line A-A of FIG. 5. As shown in the figure, the bearing portions 48 according to the present embodiment have such a shape that is obtained by making a cut-out in a member with a circular hole that is slightly larger than the cross-sectional shape of the rotation shaft 10 so that the circular hole is in communication with the outside in a side wall part of the circular hole. As a result, the rotation shaft 10 can be inserted, via communication openings H1 thus obtained, into the circular holes (however, the circular holes here are not a perfect circle, due to the above-described cut-out). In the cross-sectional view shown in FIG. 8, an angle θ of this circular hole that is made by two lines connecting a center P1 of the original circle and respective ends P2, P3 of the communication opening H1 is smaller than 180°. That is, the width of the communication opening H1 is smaller than the diameter of the rotation shaft 10. However, when the rotation shaft 10 is pressed against the communication openings H1 of the bearing portions 48, the bearing portions 48 and the rotation shaft 10 elastically deform, and the rotation shaft 10 is inserted into the circular holes of the bearing portions 48 via the communication openings H1. Note that the communication opening H1 is open upward.

When the above-described method is used to couple the rotation shaft 10 to the pair of bearing portions 48 that correspond to any one of the grooves 53 to 55, the entire door type lid 2 can rotate about the rotation shaft 10. The rotation shaft 10 is detachable with respect to the bearing portions 48, and can be removed from the bearing portions 48, similar to the case of being attached thereto, as a result of the bearing portions 48 and the rotation shaft 10 elastically deforming. Accordingly, if placement of the storage container 1 is changed, and this requires a change in direction in which the door type lid 2 is to be opened and closed with respect to the top face portion 40, it is possible to suitably adjust the opening and closing direction.

Figure 9:
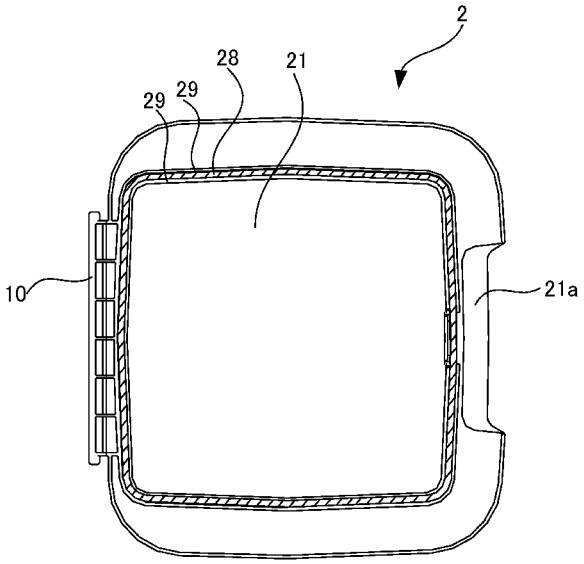
FIG. 9 is a bottom view of the door type lid.

FIG. 9 is a bottom view of the door type lid 2. As shown in the figure, the gasket 28 is attached to the door type lid 2. As a result, a configuration is achieved in which, when the door type lid 2 comes in contact with the outer peripheral frame 41*a* of the top face portion 40, that is, the door type lid 2 closes the take-out port S1, no gap is created in the coupling part between the door type lid 2 and the top face portion 40, and airtightness is maintained. Specifically, the gasket 28 according to the present embodiment is attached to the lower surface of the door body 21 in the outer peripheral direction of the door body 21. The lower surface of the door body 21 has two guide rails 29 that extend in parallel to each other in the outer peripheral direction of the door type lid 2, and the gasket 28 is arranged between these two guide rails 29. Similar to the gasket 60, the gasket 28 may be of a detachable type, or may be formed integrally with the guide rails 29 and the door body 21 without forming a gap thereto. In the state in which the door type lid 2 is closed, the gasket 28 is in contact with and adheres intimately to the outer peripheral frame 41*a* of the top face portion 40 in the entire outer peripheral direction.

3. Usage of Storage Container

As described above, the rotation shaft 10 of the door type lid 2 can be detachably coupled to the bearing portions 48 of the three grooves 53 to 55 of the container body 3. A user selects the opening and closing direction that is appropriate for the installation place or usage mode of the storage container 1, and attaches the door type lid 2 to the bearing portions 48 of one of the grooves 53 to 55 that corresponds to the selected opening and closing direction. Furthermore, when the installation place or the usage mode is changed, the door type lid 2 can be removed and attached to another one of the grooves 53 to 55.

A storage article may be stored in the storage container 1 via the take-out port S1, or via the opening S2 of the box 30. In the latter case, it is sufficient to remove the top face portion 40 from the box 30 to open the opening S2, store the storage article through the opening S2, and then close the top face portion 40 again. After the storage article has been stored in the internal space of the storage container 1, it is possible to easily open the take-out port S1 by holding the handle 21*a* and rotating the door type lid 2 about the rotation shaft 10, and to take out the storage article via the take-out port S1.

Note that, as shown in FIG. 2, the door type lid 2 according to the present embodiment is configured to be rotatable by at least 90° from the state in which the take-out port S1 is closed. Accordingly, when the user has rotated the door type lid 2 by at least 90° from the state in which the take-out port S1 is closed and then has removed his or her finger from the handle 21*a*, the open state is maintained. As a result, it is easy to put in and take out a storage article via the take-out port S1.

4. Modifications

Although the embodiment of the present invention has been described so far, the present invention is not limited to the foregoing embodiment, and various modifications are possible without departing from the spirit of the present invention. For example, the following modifications are possible. Furthermore, features of the following modifications can be appropriately combined with each other.

4-1

In the foregoing embodiment, the three coupling counterpart portions (the grooves 53 to 55, and the bearing portions 48 corresponding to the grooves) are formed in the directions in which the outer peripheral frame 41*a* extends, but the number of coupling counterpart portions to which the coupling portion (rotation shaft 10) of the door type lid 2 is coupled is not limited to the above-described number. For example, the same structures as the grooves 53 to 55 and the bearing portions 48 may be arranged on the four sides of the outer peripheral frame 41*a*, or only two sides thereof. When the grooves and the bearing portions 48 are formed on two sides of the outer peripheral frame 41*a*, an arbitrary one of the grooves 53 to 55 and the bearing portions 48 that correspond to this groove can be omitted.

4-2

The shape of the door type lid 2 and the shape of the take-out port S1 are not limited to a square shape as described in the foregoing embodiment. Note that the door type lid 2 preferably has an approximately rotationally symmetric shape, in order to achieve the structure in which the direction in which the door type lid 2 is opened and closed can easily be selected. For example, the door type lid 2 can have the shape of a circle or a regular polygon.

In the foregoing embodiment, the door type lid 2 and the take-out port S1 have a square shape, and have a configuration in which an angle that is made by a rotation axis line of the door type lid 2 with respect to the outer peripheral frame 41*a* when the coupling portion (rotation shaft 10) is coupled to one of the coupling counterpart portions (grooves 53 to 55), and a rotation axis line of the door type lid 2 with respect to the outer peripheral frame 41*a* when the coupling portion (rotation shaft 10) is coupled to another one of the coupling counterpart portions (grooves 53 to 55) is about 90° or about 180°. However, if the door type lid 2 and the take-out port S1 have the shape of a regular polygon, by, for example, forming coupling counterpart portions along the respective sides of the take-out port S1, and switching the attachment of the coupling portion to another coupling counterpart portion, it is possible to change the direction in which the door type lid is opened and closed by an angle obtained by multiplying an interior angle by an integer. Also in the case of the shape of a circle, it is possible to change the opening and closing direction by an angle made by the coupling counterpart portions.

4-3

The structure for rotating the door type lid 2 is not limited to the above-described structures. For example, it is also possible that a plurality of rotation axes 10 are provided on the top face portion 40 side, and a groove and bearing portions 48 for rotatably receiving any one of the rotation axes 10 are provided on the door type lid 2 side. Alternatively, the rotation shaft 10 and the top face portion 40 may respectively be provided with claws that engage with each other rotatably. Accordingly, the coupling structure between the door type lid 2 and the top face portion 40 may be of any mode, as long as the door type lid 2 can be rotatably coupled to the outer peripheral frame 41*a*, which is a door frame.

REFERENCE SIGNS LIST

1 Storage container
2 Door type lid
3 Container body
10 Rotation shaft (coupling portion)
30 Box
40 Top face portion
41*a* Outer peripheral frame
48 Bearing portion (coupling counterpart portion)
53 to 55 Groove (coupling counterpart portion)
S1 Take-out port

The invention claimed is:

1. A storage container comprising:

a container body having an outer peripheral frame that defines a take-out port; and a door type lid that is capable of being attached to the outer peripheral frame, and is configured to open and close the take-out port, wherein the outer peripheral frame includes a plurality of coupling counterpart portions that extend in directions in which the outer peripheral frame extends, the door type lid includes a coupling portion that is capable of being detachably coupled to any of the coupling counterpart portions, and the coupling portion and the coupling counterpart portions are configured such that, in a state in which the coupling portion is coupled to any of the coupling counterpart portions, the door type lid can be rotated with respect to the outer peripheral frame in order to open and close the take-out port, and wherein the container body has a box that has an opening on its top face side and a top face portion on which the outer peripheral frame is provided, the top face portion being detachably attached to the box, and the outer peripheral frame is provided at an eccentric position on the top face portion.

2. The storage container according to claim 1, wherein the outer peripheral frame has at least three coupling counterpart portions that extend in directions in which the outer peripheral frame extends.

3. The storage container according to claim 1, wherein the door type lid has an approximately rotationally symmetric shape when viewed in a plan view.

4. The storage container according to claim 3, wherein the door type lid has an approximately regular polygonal shape when viewed in a plan view.

5. The storage container according to claim 4, wherein the door type lid has an approximately square shape when viewed in a plan view.

6. The storage container according to claim 1, wherein an angle that is made by a rotation axis line of the door type lid with respect to the outer peripheral frame when the coupling portion is coupled to one of the plurality of coupling counterpart portions, and a rotation axis line of the door type lid with respect to the outer peripheral frame when the coupling portion is coupled to another one of the plurality of coupling counterpart portions is approximately 90°.

7. The storage container according to claim 1, wherein a rotation axis line of the door type lid with respect to the outer peripheral frame when the coupling portion is coupled to one of the plurality of coupling counterpart portions, and a rotation axis line of the door type lid with respect to the outer peripheral frame when the coupling portion is coupled to another one of the plurality of coupling counterpart portions are approximately parallel to each other.

8. The storage container according to claim 1, wherein the coupling portion is either one of a portion that defines an opening and an insertion portion that is inserted into the opening, and the coupling counterpart portion is the other one.

9. The storage container according to claim 2, wherein the door type lid has an approximately rotationally symmetric shape when viewed in a plan view.

10. The storage container according to claim 9, wherein the door type lid has an approximately regular polygonal shape when viewed in a plan view.

11. The storage container according to claim 10, wherein the door type lid has an approximately square shape when viewed in a plan view.

12. The storage container according to claim 2, wherein an angle that is made by a rotation axis line of the door type lid with respect to the outer peripheral frame when the coupling portion is coupled to one of the plurality of coupling counterpart portions, and a rotation axis line of the door type lid with respect to the outer peripheral frame when the coupling portion is coupled to another one of the plurality of coupling counterpart portions is approximately 90°.

13. The storage container according to claim 3, wherein an angle that is made by a rotation axis line of the door type lid with respect to the outer peripheral frame when the coupling portion is coupled to one of the plurality of coupling counterpart portions, and a rotation axis line of the door type lid with respect to the outer peripheral frame when the coupling portion is coupled to another one of the plurality of coupling counterpart portions is approximately 90°.

14. The storage container according to of claim 2, wherein a rotation axis line of the door type lid with respect to the outer peripheral frame when the coupling portion is coupled to one of the plurality of coupling counterpart portions, and a rotation axis line of the door type lid with respect to the outer peripheral frame when the coupling portion is coupled to another one of the plurality of coupling counterpart portions are approximately parallel to each other.

15. The storage container according to of claim 3, wherein a rotation axis line of the door type lid with respect to the outer peripheral frame when the coupling portion is coupled to one of the plurality of coupling counterpart portions, and a rotation axis line of the door type lid with respect to the outer peripheral frame when the coupling portion is coupled to another one of the plurality of coupling counterpart portions are approximately parallel to each other.

16. The storage container according to claim 2, wherein the coupling portion is either one of a portion that defines an opening and an insertion portion that is inserted into the opening, and the coupling counterpart portion is the other one.

17. The storage container according to claim 3, wherein the coupling portion is either one of a portion that defines an opening and an insertion portion that is inserted into the opening, and the coupling counterpart portion is the other one.

* * * * *